United States Patent [19]

Wisneski

[11] 4,360,044

[45] Nov. 23, 1982

[54] POLYMER MIXING APPARATUS

[75] Inventor: Peter M. Wisneski, Houston, Tex.

[73] Assignee: Gulf Oil Corporation, Pittsburgh, Pa.

[21] Appl. No.: 250,988

[22] Filed: Apr. 3, 1981

[51] Int. Cl.[3] ..... B65B 1/04

[52] U.S. Cl. ..... 141/9; 141/100; 222/547; 222/564; 366/9; 366/33; 366/49; 366/341

[58] Field of Search ..... 141/9, 100–110, 141/234, 236, 237, 238, 244, 245; 222/547, 564; 366/9, 30, 33, 49, 341

[56] References Cited

U.S. PATENT DOCUMENTS

| | | | |
|---|---|---|---|
| 1,925,541 | 9/1933 | Noble | 366/33 |
| 3,977,657 | 8/1976 | Shearer et al. | 366/341 |
| 4,023,779 | 5/1977 | Beloy | 366/30 |

*Primary Examiner*—Houston S. Bell, Jr.
*Attorney, Agent, or Firm*—Richard L. Kelly

[57] ABSTRACT

Apparatus is provided for blending large batches of particulate polymers that are compositionally heterogeneous into batches that are compositionally uniform. The apparatus consists of a plurality of horizontally aligned cylindrical storage bins, a common feed line for feeding particulate polymer to each of the storage bins, and conveying means running under each of the storage bins to receive particulate polymer discharged from the bins. Each bin contains six or more vertically aligned partition walls that extend radially from the midpoint of the bin to the wall to divide the bin into at least six storage compartments of substantially equal volumetric capacity. The vertical partition walls differ in height in a regular descending order so that as material is charged to and fills one compartment, it overflows the shorter wall to fill the adjacent compartment. Upon being discharged from the bin, the contents of the several compartments of the bin are mixed to provide a more homogeneous batch of particles.

10 Claims, 4 Drawing Figures

Fig. 1
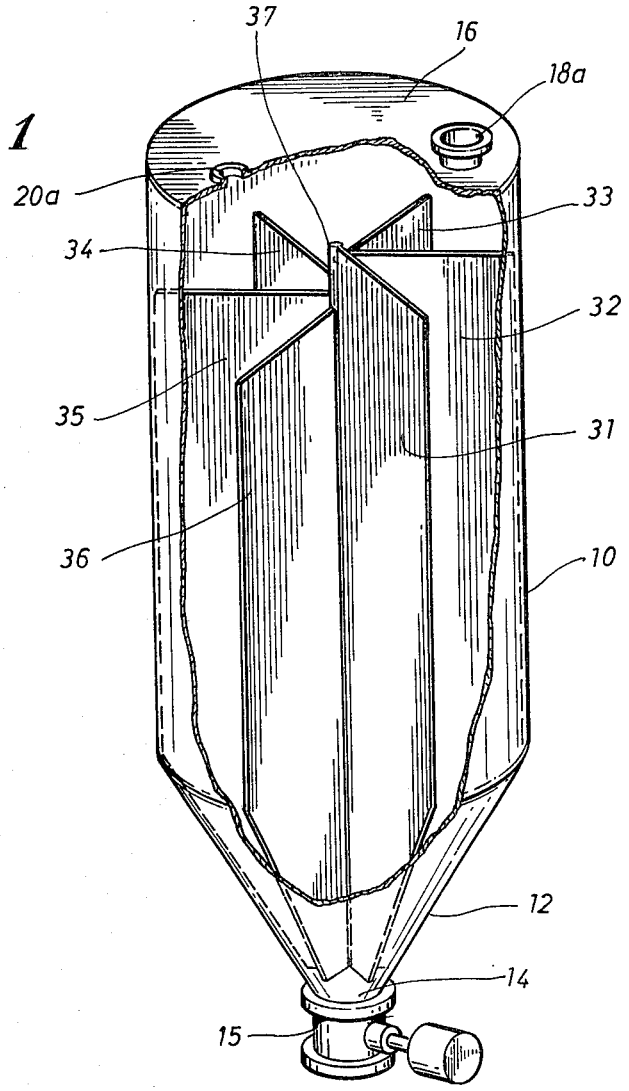
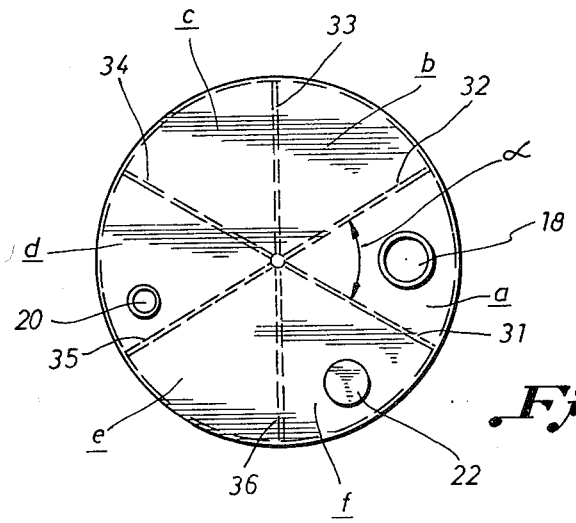
Fig. 2

POLYMER MIXING APPARATUS

BACKGROUND OF THE INVENTION

In the manufacture of particulate polymers, e.g., high pressure polyethylene, it is observed that certain lots of product will have a desired property such as melt index which falls outside of product specifications. To provide a maximum percentage of product falling within product specifications, the manufacturer will blend a product lot having an undesirably high melt index with a product lot having an undesirably low melt index. The resulting mixed lot will have a melt index within specifications. Such lots customarily are mixed in rotary mixers and/or remelted and extruded. Such reprocessing entails high labor costs and, in addition, high energy costs when an extrusion step is emloyed.

SUMMARY OF THE INVENTION

The present invention provides apparatus for blending large batches of particulate polymers that are compositionally heterogeneous into batches that are compositionally uniform. The apparatus consists of a plurality of horizontally aligned cylindrical storage bins, a common feed line for feeding particulate polymer to each of the storage bins, and conveying means running under each of the storage bins to receive particulate polymer discharged from the bins. Each bin contains six or more vertically aligned partition walls that extend radially from the midpoint of the bin to the wall to divide the bin into at least six storage compartments of substantially equal volumetric capacity. The vertical partition walls differ in height in a regular descending order so that as material is charged to and fills one compartment, it overflows the shorter wall to fill the adjacent compartment. Upon being discharged from the bin, the contents of the several compartments of the bin are mixed to provide a more homogeneous batch of particles.

BRIEF DESCRIPTION OF THE DRAWINGS

FIG. 1 is a perspective view of a single storage bin with parts broken away.

FIG. 2 is a top plan view of the storage bin shown in FIG. 1.

DETAILED DESCRIPTION OF THE INVENTION

Figure 3:
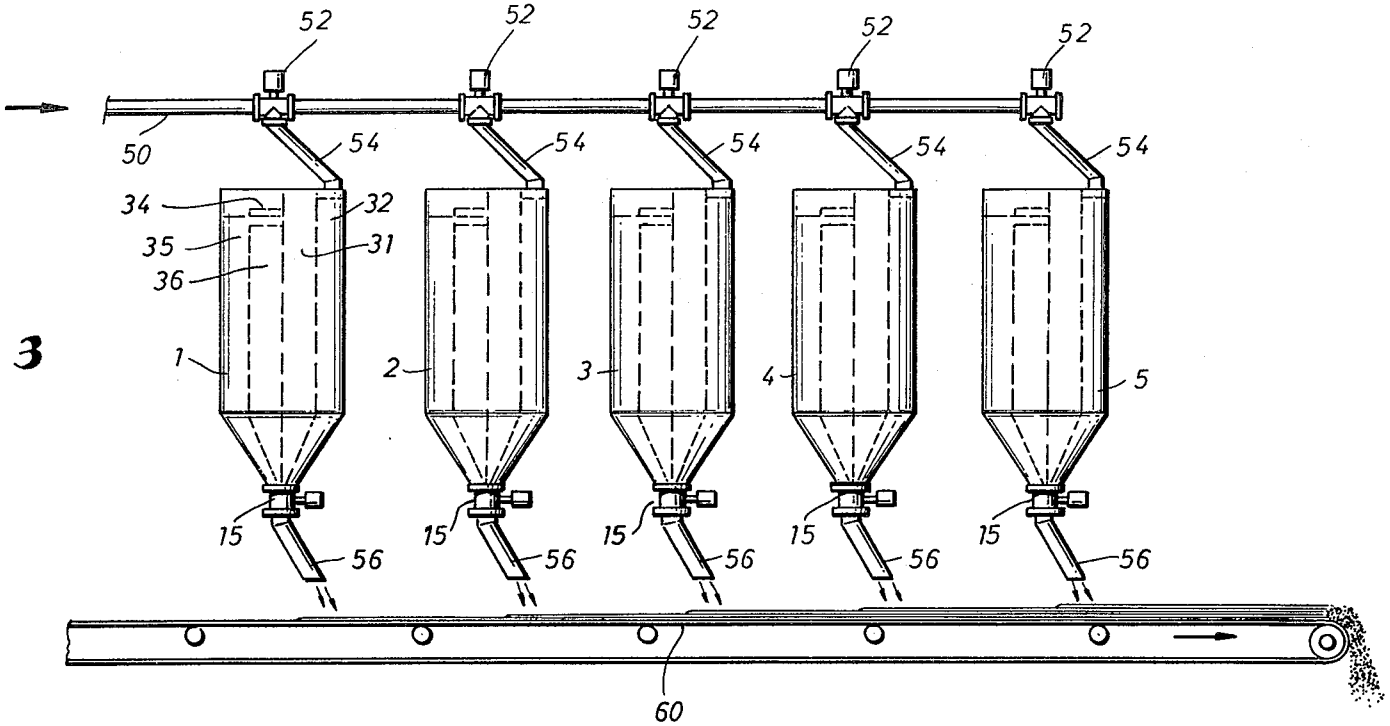
FIG. 3 is an elevation showing the manner in which the several bins are filled and subsequently emptied onto a conveyor belt.

As seen in FIG. 1, the storage bin has a principal section 10 of cylindrical shape which terminates in a bottom section 12 of conical shape to provide ready gravity flow of particles from the discharge port 14 of the bin. A gate valve 15 is provided to discharge the contents from the bin. The top 16 of the bin is provided with a product entry port 18, a vent port 20, and an access port 22 to provide entry into the bin to make inspections and/or repairs. Suitable threaded covers 18*a*, 20*a*, and 22*a* are provided to seal ports 18, 30, and 22 when the bin is not in use. The covers 20*a* and 22*a* preferably have a transparent section for visual inspection to determine the level of the contents in various sections of the bin. The interior of the bin is provided with a series of 6 vertical partition walls 31, 32, 33, 34, 35, and 36. The vertical interior edge of each partition wall fits tightly into channels provided in a centrally positioned vertical rod-like member 37. The partition walls extend radially from member 37 and fit tightly against the inner wall of the bin to subdivide the bin into a series of 6 pie-shaped compartments a, b, c, d, e, and f. The cross sectional area of each compartment is fixed by the angle $\alpha$ defined by its 2 partition walls; these angles being defined as, respectively, $\alpha$(31, 32) for compartment a, $\alpha$(32, 33) for compartment b, and so forth. In the embodiment shown, each of the $\alpha$ angles is the same and is 60°. The bottoms of each partition wall 31, 32, 33, 34, 35, and 36 are cut to lie in a common plane (normal to the plane of gravity) which is positioned as close as practical to the discharge port 14. This construction prevents any significant upward flow from any filled compartment into any unfilled compartment. In addition, this construction assures that the particles from each compartment will be discharged at a substantially uniform volumetric rate when valve 15 is opened.

In the embodiment illustrated in FIG. 1, the shape of each partition wall 31 through 36 is identical except that each differs in height from the others. The order of the heights is such that 31>32>33>34>35>36. The partition walls are actually higher than shown in FIG. 1. They are shown in reduced height so that the differences in height are seen more easily in the perspective view shown. The effective depth, and thus the volumetric capacity, of each compartment a, b, c, d, e, and f is controlled by the height of its shorter wall. As the angles $\alpha$ are the same for each compartment, the respective volumetric capacity of the compartments is a>b>c>d>e>f. To provide a bin in which each compartment has an equal volumetric capacity, the partition walls should be arranged so that $\alpha$(36, 31)>$\alpha$(35, 36)>$\alpha$(34, 35)>$\alpha$(33, 34)>$\alpha$(32, 32)>$\alpha$(31, 32). The precise differences in the sizes of angles will be dependent upon the respective heights of the partition walls and can be readily calculated by those skilled in the art.

The entry port 18 of each bin is positioned directly above compartment a so that particulate polymer charged to the bin flows directly into compartment a. When compartment a is filled, additional materials charged to the bin overflows partition wall 32 and falls into compartment b. As the filling action is continued, particulate matter successively and sequentially overflows partition walls 33, 34, 35, and 36 to fill comaprtments c, d, e, and f. The respective heights of partition walls 31, 32, 33, 34, 35, and 36 will be fixed to assure that the compartments of the mixer are filled in this order. In particular, the partition wall 31 will extend to the top of the bin to prevent any overflow of material from compartment a into compartment f.

While the drawings illustrate bins having 6 partition walls which divide the interior of the bin into 6 compartments of substantially equal volumetric capacity, it is feasible to provide 7 or more partition walls to divide the bin into 7 or more compartments. It has been the inventor's experience that 6 compartment bins provide adequate mixing for most purposes.

The specific heights of the partition walls employed in the bins will be somewhat dependent upon the flow characteristics of the particulate polymer to be stored in the bins. The flow characteristics of particulate polymers are proportional to their angles of repose. For many polymers, such angles are known and reported in the literature. Where such angles are not known, they can be readily determined by known methods. The required differentials in height between adjacent partition walls will be directly proportional to the angles of repose of the particulate polymers to be stored. The highest of the partition walls should extend to the top of the bin. This will prevent any flow of charged polymer to the last of the concentrically arranged storage compartments. Each of the remaining partition walls should have its height reduced by the amount required to provide ready overflow from one filled storage compartment to the adjacent unfilled compartment.

Figure 4:
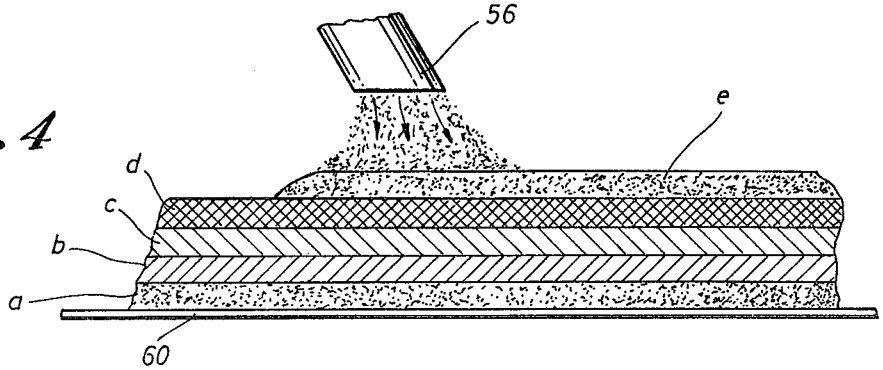
FIG. 4 is an enlarged view showing the manner in which the particulate polymer from the several bins are mixed in being conveyed to a down stream packaging station.

FIG. 3 shows five (5) bins 1, 2, 3, 4 and 5 arranged in horizontal alignment. Each bin is identical in size and construction. A product delivery line 50 fitted with valves 52 feeds particulate polymer to the storage bins via lines 54. As subsequently described, each bin is filled in sequence. At the time of discharge, valves 15 of each of bins 1, 2, 3, 4, and 5 are opened simultaneously so as to discharge the particulate polymer onto an endless conveyor belt 60. FIG. 4 illustrates that the product from the several bins forms layers on the belt 60 with layer a being the product discharged from bin 1, layer b being the product discharged from bin 2, and so forth. The particulate product is discharged from belt 60 to a packaging station not shown.

In operation of the embodiment illustrated in FIG. 3, each of bins 1, 2, 3, 4, and 5 will be empty at the beginning of the operational cycle. Particulate polymer, such as pelleted polyethylene, is fed via line 50 to the first valve 52 and through the first line 54. This material begins to fill compartment a of bin 1. After compartment a is filled, the polymer particles flowing into bin 1 overflow wall 32 and being filling compartment b. This action is continued until each of the compartments of bin 1 is filled. The flow of the particulate polymer to bin 1 will be measured and first valve 52 will be closed at the appropriate time so that the volume of particulate polymer charged will be, to the extent practical, precisely equal the volumetric storage capacity of the several storage compartments of the bin. It will be recognized that some free space will remain above each of the storage compartments of the bin. This is desirable for reasons discussed infra. After bin 1 is filled, bins 2, 3, 4, and 5 will be filled in sequence in the same manner.

After all of the bins have been filled, the conveyor belt 60 is started and the valves 15 of each of bins 1, 2, 3, 4, and 5 are opened simultaneously and product from each bin is discharged through lines 56. The product being discharged from each bin will contain an equal volume fraction from each of storage compartments a, b, c, d, e, and f. It is thus seen that the product being discharged, by reason of containing an equal volume fraction from each of the storage compartments, blends particulate polymer produced over a significant time period and tends to even out periodic variations in product properties such as melt index. As was noted earlier, it is desirable not to fill the designed free space of the storage bins with polymer. As noted, the content of each of the individual storage compartments in a bin is discharged at the same rate. As a consequence, any excess particulate polymer initially occupying the designed free space in the bin will not be mixed with any of the particulate polymer stored in the storage compartments.

As illustrated in FIG. 4, the particulate polymer tends to form layers a, b, c, d, and e on conveyor belt 60. Each layer of course is homogeneous by reason of being a blend formed by mixing material from the six storage compartments of each bin. When the material is discharged from the conveyor belt to the packaging station not shown, the material in each of the layers a, b, c, d, and e becomes intimately mixed. Thus, the material that is packaged and delivered to the user is made up of substantially equal proportions of material from each of the 30 storage compartments in the five bins illustrated. Accordingly, the periodic variations in polymer properties are evened out.

If desired, the apparatus of FIG. 3 can be modified by employing a pneumatic conveying system in lieu of the conveyor belt shown. In this embodiment of the invention, lines 56 are connected to a large capacity pneumatic conveying line. Gate valves 15 are replaced with rotary feeders which function as discharge valves.

The apparatus and method of the invention are particularly well suited for the manufacture of large batches of particular polymers. By way of example, by employing a series of five bins, each of which contains an effective volumetric capacity of about 6,500 $ft^3$, it is possible to prepare single uniform batches of one million pounds of polyethylene. These figures are based upon the consideration that a cubic foot of polyethylene pellets weighs about 32 lbs. Storage bins of this capacity are easily manufactured. The bins should be constructed to discharge product at a rate of at least about 650 $ft^3$/hour.

While the operation of the process has been described in terms of emptying all of the bins simultaneously, special situations may arise when it is desirable to empty and collect product from only a single bin or from selected bins. In particular, when a continuous polyethylene reactor is undergoing change from the manufacture of one product type to another type having significantly different properties, it is recognized that the product collected during the transition period may not be truly suitable for use with either the previously prepared or the subsequently prepared product. To segregate and provide special handling for such product, a log can be kept of the bins and individual compartments in which the transition product is stored. Samples of such product can be taken as the particular bins and/or particular compartments thereof are being filled. By analysis of such samples, the manufacturing personnel can have accurate knowledge of the composition and properties of product stored in each bin and possibly even individual compartments of such bin. From such data, product not desired for delivery under a particular product designation can be separately withdrawn from 1, 2 or more bins for sale under special designated specifications.

While the use of the apparatus has been described to prepare compositionally uniform blends of particulate polymers, it obviously can be used to prepare uniform blends of other types of particulate products.

What is claimed:

1. Apparatus for preparing large batches of particulate polymers having a substantially uniform composition throughout which consists essentially of:

A. A plurality of horizontally aligned cylindrical storage bins;

B. A common feed line including means for feeding particulate polymers to each of the storage bins of (A); and C. Conveying means running under each of the storage bins of (A) to receive particulate polymers discharged therefrom;

each of the storage bins of (A) being essentially identical in volumetric capacity and construction; each of said storage bins being essentially cylindrical in shape and including:

(1) a principal section that is essentially cylindrical in shape, (2) a bottom section of conical shape to provide ready gravity flow of particles from the bin, (3) a centrally positioned discharge port in the bottom of the bin, (4) a valve in said discharge port, (5) a series of at least six vertical partition walls within the bin, each of which extends radially from the midpoint of the bin to the bin wall to divide the bin into at least six storage compartments, said vertical partition walls being further characterized in that;

(a) the partition walls are of varying height with each wall other than the highest wall being higher than one adjacent wall and lower than the other adjacent wall, (b) the angles formed between each adjacent pair of partition walls being substantially equal so that each storage compartment has substantially an equal volumetric capacity, (c) the differences in height of the partition walls are such that as each storage compartment is filled with particles, additional particles added to the top of said compartment readily overflow into the adjacent compartment, and (d) the bottom of each partition wall extends to within inches of the discharge port, the bottom construction of the partition walls being such that particles flow by gravity at substantially equal volumetric rates from each compartment when the valve of the discharge port is opened, and (6) an inlet port in the top of the bin positioned so that particles fed therethrough flow by gravity directly into the compartment defined by the first and second highest vertical partition walls.

2. Apparatus of claim 1 having at least five storage bins.

3. Apparatus of claim 2 in which each storage bin has an effective storage capacity of at least about 6,500 $ft^3$.

4. Apparatus of claim 1, 2, or 3 in which each storage bin is further characterized in that particulate polymer can be discharged therefrom at a rate of at least about 650 $ft^3$/hour.

5. A process for preparing a large batch of particulate material having a substantially uniform composition throughout which consists essentially of:

A. Filling in sequence a plurality of empty, horizontally aligned, essentially cylindrical storage bins with particulate material, B. Simultaneously emptying each of the storage bins of (A) at a uniform rate onto a conveying means; and C. Conveying the mixed particulate, material to a packaging station;

the process further characterized in that each storage bin of (A) is essentially identical in volumetric capacity and construction and includes:

( 1) a principal section that is essentially cylindrical in shape, (2) a bottom section of conical shape to provide ready gravity flow of particles from the bin, (3) a centrally positioned discharge port in the bottom of the bin, (4) a valve in said discharge port, (5) a series of at least six vertical partition walls within the bin, each of which extends radially from the midpoint of the bin to the bin wall to divide the bin into at least six storage compartments, said vertical partition walls being further characterized in that;

(a) the partition walls are of varying height with each wall, other than the highest wall, being higher than one adjacent wall and lower than the other adjacent wall, (b) the angles formed between each adjacent pair of partition walls being substantially equal so that each storage compartment has substantially an equal volumetric capacity, (c) the differences in height of the partition walls are such that as each storage compartment is filled with particles, additional particles added to the top of said compartment readily overflow into the adjacent compartment, and (d) the bottom of each partition wall extends to within inches of the discharge port, the bottom construction of the partition walls bein such that particles flow by gravity at substantially equal volumetric rates from each compartment when the valve of the discharge port is opened, and (6) an inlet port in the top of the bin positioned so that particles fed therethrough flow by gravity directly into the compartment defined by the first and second highest vertical partition walls.

6. A process of claim 5 in which at least five storage bins are filled.

7. A process of claim 6 in which each storage bin has an effective storage capacity of at least about 6,500 $ft^3$.

8. A process of claim 7 in which each storage bin has an effective storage capacity of at least about 6,500 $ft^3$.

9. A process of claim 5, 6, 7, or 8 in which the bins of (A) are emptied at a rate of at least about 650 $ft^3$/hour.

10. A process of claim 5 in which the particulate material is a particulate polymer.

* * * * *